United States Patent [19]

Putyra

[11] 4,160,295

[45] Jul. 10, 1979

[54] TOILET SHROUD

[76] Inventor: Donald J. Putyra, 659 Chapman Dr., Corte Madera, Calif. 94925

[21] Appl. No.: 863,872

[22] Filed: Dec. 23, 1977

[51] Int. Cl.[2] ..... E03D 11/02

[52] U.S. Cl. ..... 4/420; 4/1

[58] Field of Search ..... 4/1, 300, 420, 191; 211/180; 248/304

[56] References Cited

U.S. PATENT DOCUMENTS

| | | | |
|---|---|---|---|
| 2,491,756 | 12/1949 | Muench | 211/180 |
| 3,408,661 | 11/1968 | Hammond | 4/1 |
| 3,488,025 | 1/1970 | Rowland | 248/304 |
| 3,566,414 | 3/1971 | Basner | 4/1 |
| 3,928,874 | 12/1975 | Albertson | 4/1 |

*Primary Examiner*—Lenard A. Footland

*Attorney, Agent, or Firm*—James R. Cypher

[57] ABSTRACT

A covering for the outer portion of a toilet concealing the fixture below the rim of the bowl. The covering consists of a flexible material which can closely fit the countours of the fixture which is either washable or disposable. A plurality of hooks which removably attach to the rim of the fixture are placed at intervals and the covering is removably attached to the hooks.

1 Claim, 8 Drawing Figures

TOILET SHROUD

BACKGROUND OF THE INVENTION

Two types of water closets had been patented by the end of the 18th century—Cummings' in 1775 and Bramah's in 1778. These marvelously simple fixtures ended the inconvenience of the garden privy and the nastiness of the chamber pot which had burdened mankind for so long. No matter how elegant chamber pots were fashioned or how well hidden in furniture or behind screens, they remained the butt of jokes and rude remarks. By the late 1800's, the indoor vitreous enamel water closet was painted with chrysanthemum and other flower patterns, perhaps a vestigial reminder of more pleasant outdoor surroundings from which this lowly device descended. The reticence of displaying bathroom fixtures remains to this day with the building of special rooms cloaked with the euphemism "bath" room and with the fixtures themselves partially covered by plush fabric fitted to the water tank and the seat cover. The uncovered porcelain enamel bowl, however, remains a highly visible reminder of the identity of the fixture.

SUMMARY OF THE INVENTION

The gist of the present invention is the use of a fabric or other flexible material which is hung like a skirt about the bowl of a toilet to shroud the fixture. The material is preferably attached to hooks which are placed on the bowl of the fixture so that the material may be removed for cleaning in the standard washing machine.

Another feature of the present invention is that it may be made from a sound deadening material which will reduce the flushing noise of the fixture when it is evacuated.

Still another feature of the invention is to remove the reticence of displaying the toilet fixture in the home so as to permit a more open design for the so called "bath room" and to permit home architects the freedom to use the indoor furniture "landscaping" techniques that they have used so successfully in other rooms of the house.

DESCRIPTION OF THE INVENTION

Figure 1:
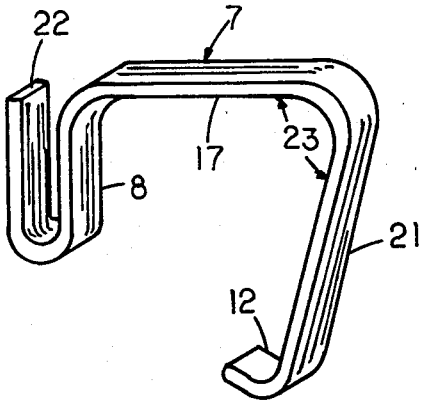
FIG. 1 is a perspective view of a toilet skirt hook used in the present invention.

The toilet shroud of the present invention for the bowl 1 of a toilet fixture 2 consists briefly of an elongated flexible material 3 having an outer surface 4 selected to present an aesthetic appearance and dimensioned to substantially cover the portion of the toilet between the floor and the rim 6 of the bowl and attachment means 7 including a grip portion to attach the material to the attachment means and a hook portion to attach the means to the toilet.

The grip portion of the attachment means includes a U-shaped portion 8 dimensioned to hold a portion 9 of the flexible material and the flexible material is folded and tacked along one edge 11 to form a loop for receiving the U-shaped portion of the attachment means.

The hook portion of the attachment means includes a J-shaped portion 12 adapted for attachment to the inner edge 13 of a toilet bowl.

The elongated flexible material may be any decorative material such as machine washable nylon carpet-like material or polyester fur-look material with thick pile. The material may have a waffle latex grid back or other reinforcement to give the material body and strength.

Figure 5:
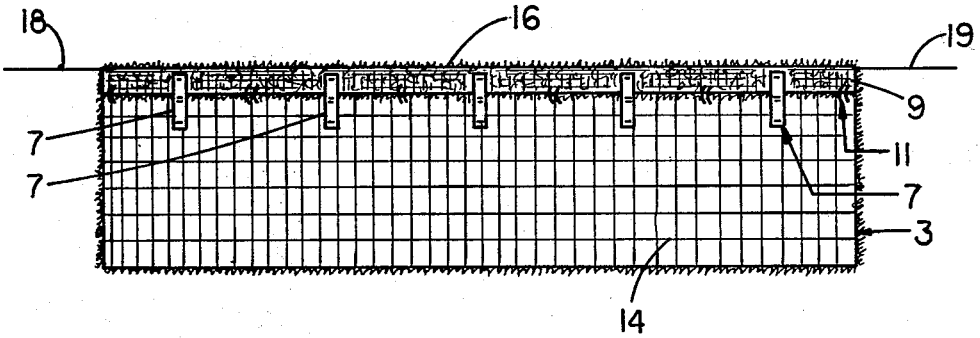
FIG. 5 is a plan view of the toilet shroud with a plurality of hooks in place.

One method of attaching the material to the attaching means is to fold one side of the material along a fold line 16 and to sew or tack by other means the edge 11 to the material. The portion 9 of the material is then inserted into the opening of the U-shaped portion 8 of the attachment means 7. Several attachment means are attached in like manner at spaced intervals, as shown in FIG. 5. To attach the shroud to the toilet, it is a simple matter to place the horizontal portion 17 of the attachment means over the rim 6 of the toilet and hook the J-shaped portion 12 under the inner edge 13 of the bowl.

Preferably, a tack should be placed in the material approximately every 3 inches.

Figure 2:
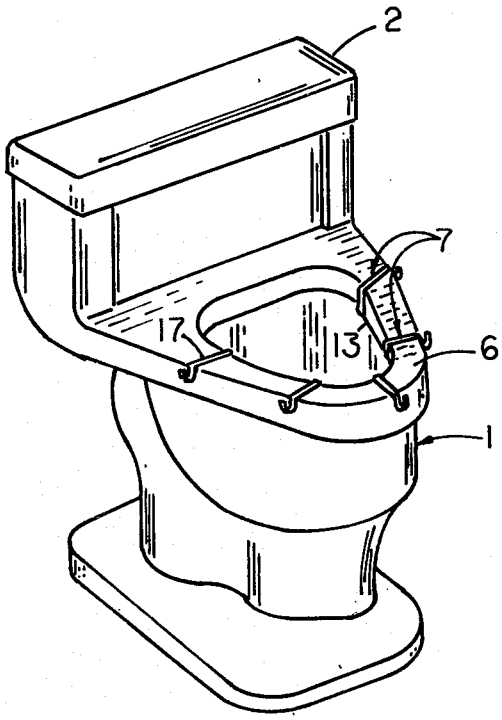
FIG. 2 is a perspective view of a toilet fixture with the hooks of FIG. 1 in place.

The method of attachment of the shroud may be reversed, in that the attachment means may first be attached to the toilet as shown in FIG. 2 and then the material 3 is attached to the attachment means.

I have illustrated and described only one means of attaching the shroud to the toilet. It is obvious that other means of attachment may be used. I have also illustrated and described one type of material. Again, plastic with design imprints could be used or many other types of decorative materials.

Figure 3:
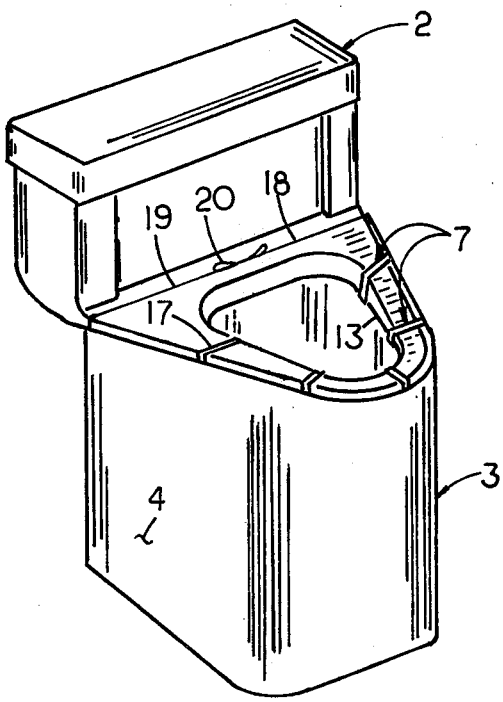
FIG. 3 is a perspective view of a toilet fixture with the toilet shroud or skirt of the present invention in place.

In some installations, it may be advantageous to attach a pair of strings 18 and 19 to the ends of the material and tie them together in a simple bow knot 20 across the back of the bowl as shown in FIG. 3. This will assist in keeping the shroud in place in some installations.

Strings 18 and 19 may be made from elastic material.

The attachment means may have various configurations so that it is more easily adaptable to different shape toilet bowls. In most instances, however, the attachment means illustrated will suffice. The length of the horizontal portion 17 may vary for different bowls and the elongated portion 21 which is a part of the J-shaped portion may vary. These attachment means may be made from plastic which is easily cleaned and inexpensive to manufacture. They may also be made from bendable sheet metal or wire so that they can be adapted to various types of fixtures. Preferably, the end 22 is rounded or blunt so that it will not tear the material.

Referring to FIG. 1, the attachment means 7 is preferably constructed so that angle 23 where portion 17 and portion 21 intersect is less than a right angle. When installed as in FIG. 2, the attachment is forced over the rim 6 of the toilet and the portion 21 is sprung outwardly so that angle 23 approaches a 90° angle. This construction causes the attachment to cling to the fixture more snugly.

Figure 7:
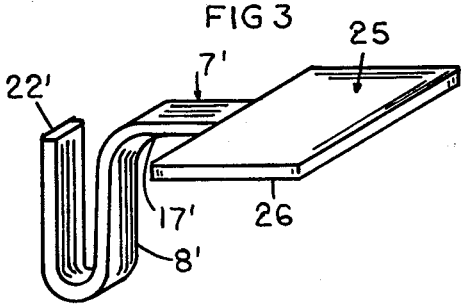
FIG. 7 is an enlarged perspective view of an alternate form of hook.
Figure 8:
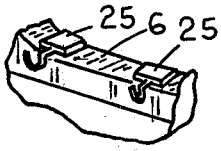
FIG. 8 is a perspective view of the hook shown in FIG. 8 installed on a portion of a toilet bowl.
Figure 4:
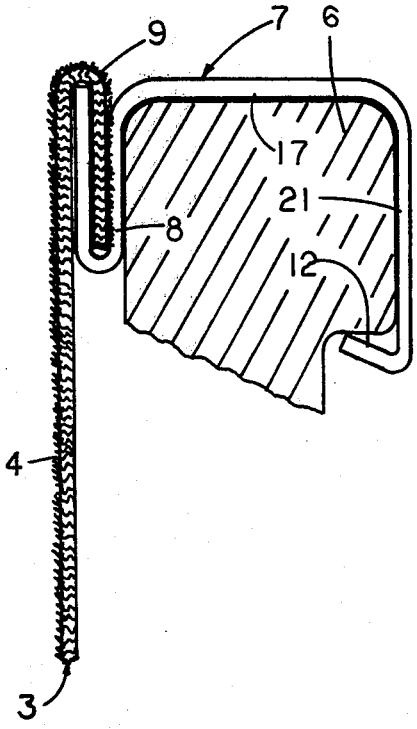
FIG. 4 is a side view of the hook of FIG. 1 with a portion of the shroud in cross section.
Figure 6:
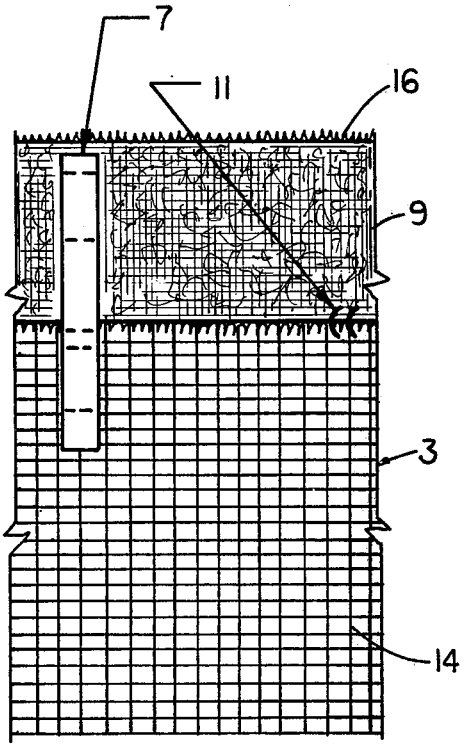
FIG. 6 is an enlarged view of a single hook in place on a portion of the shroud shown in FIG. 5.

FIGS. 7 and 8 illustrates an alternative form of attachment means 7'. Instead of a portion 21 and J-hook portion 12, the attachment member is formed with a plate 25 which is attached to the horizontal portion 17'. The U-shaped portion 8' and end 22' are identical to the attachment shown in FIG. 1. To attach the attachment 7', to the rim 6 of a toilet bowl 1, cement or other adhesive is applied to the underside surface 26 of plate 25. The shroud 3 is then attached in the manner described above. I claim:

1. A toilet shroud comprising:

a. an elongated flexible washable material having an outer surface selected to present an aesthetic appearance and dimensioned to substantially cover the portion of a toilet between the floor and the rim of the bowl;

b. re-useable attachment means including a grip portion to removably attach said material to said attachment means and a hook portion to attach said means to said toilet;

c. said grip portion of said attachment means includes a U-shaped portion dimensioned to hold a portion of said flexible material;

d. said flexible material is folded and tacked along one edge to form a loop for receiving the U-shaped portion of said attachment means;

e. said hook portion of said attachment means includes a J-shaped portion adapted for attachment to the inner edge of a toilet bowl; and f. said attachment means is formed from a washable material having sufficient rigidity to support said elongated flexible material and sufficient resiliency so that said J-shaped portion can be sprung outwardly as it is forced over said toilet bowl rim and so that it will automatically return to its original shape or nearly so to cling tightly to said rim.

* * * * *